United States Patent [19]

Bahr

[11] Patent Number: 4,696,715

[45] Date of Patent: Sep. 29, 1987

[54] PICK-AND-PLACE GLUE APPLICATOR

[75] Inventor: Melford J. Bahr, Corcoran, Minn.

[73] Assignee: MGS Machine Corporation, Minneapolis, Minn.

[21] Appl. No.: 828,389

[22] Filed: Feb. 11, 1986

[51] Int. Cl.[4] ..... B65C 9/12

[52] U.S. Cl. ..... 156/568; 156/571; 156/DIG. 31; 271/33; 271/276; 414/129

[58] Field of Search ..... 156/568, 571, DIG. 31; 271/33, 95, 276; 414/121, 128, 129

[56] References Cited

U.S. PATENT DOCUMENTS 4,350,466 9/1982 Bahr et al. ..... 414/128

4,605,459 8/1986 Voltmer et al. ..... 156/568 X

*Primary Examiner*—Robert A. Dawson

*Attorney, Agent, or Firm*—Merchant, Gould, Smith, Edell, Welter, & Schmidt

[57] ABSTRACT

A pick-and-place glue applicator is disclosed having a drive shaft mounted on a frame member for rotation about a primary axis of rotation. A support shaft is mounted on the frame member for rotation about a secondary axis of rotation which is parallel to and spaced from the primary axis. Planetary gearing causes the support shaft to orbit the primary axis and rotate about the secondary axis in a direction opposite the direction of the orbit. A suction cup is secured to the support shaft and extends radially therefrom to a suction end. The suction cup moves in a generally hypotrochoidal path. The hypotrochoidal path includes three positions where the suction cup is facing outwardly away from the primary axis. The three outwardly projecting positions are connected by connecting paths where the suction cups face inwardly toward the axis. A glue applicator is disposed within the area bounded by the hypotrochoidal path and presents a glue applying surface opposing a linear portion of the continuing path between an article pick up location and an article discharge location. As an article carried by the suction cup moves across the connecting path, it receives an elongated bead of glue from the glue applicator.

11 Claims, 19 Drawing Figures

IV
VII
VI
III
V
10
12
13
14
16
18
20
22
24
26
28
30
32
34
36
37
40
42
56
67
69
76
79
83
86
88
92
94
95
96
98
102
106
108
110
118
122
200
202
204
206
210
216
218
400
402
404
406
408
410
411
414
420
422
424
426
428
430
446
448
450
458

218a'
218'
300b
300a
122
300
300a'
12
200'
13
X-X
300c'
300b'
300c

122a'
122

300
122
300a'
300b
12
300b'
300a
218
200
13
X-X
300c'
300c 122
122a

PICK-AND-PLACE GLUE APPLICATOR

BACKGROUND OF THE INVENTION

I. Field of the Invention

This invention pertains to article-handling apparatus and, more particularly, to an apparatus which selects an item from a first station and applies a glue to the item before depositing the glued item at a subsequent station.

II. Description of the Prior Art

In the prior art, material handling devices (commonly referred to as pick-and-place machines) are well known. These devices have many uses. For example, in the printing industry such machines remove a piece of paper from a top of a pile and transfer the sheet to a second location such as a conveyor which moves the sheet into a press or other machine. Such devices are also used in the container industry to pick coupons from a tray and place them in a desired location. Additionally, in conjunction with various glue applicators, a pick-and-place machine may select a coupon from a pile and advance the coupon past a glue applicator where it receives a metered amount of glue. The glued coupon is then placed in adhesive contact with the carton.

An example of a pick-and-place machine is shown in commonly assigned U.S. Pat. No. 4,350,466 of which I am co-inventor. This patent teaches a pick-and-place machine having four support shafts mounted for rotation about their respective axes with the axes of the support shafts circumferentially spaced about a common drive shaft and parallel to the drive shaft. As the drive shaft rotates in a given direction, each of the support shafts rotates in an opposite direction. Suction cups carried by the support shafts are in air flow communication with a common manifold with the suction cups being alternately connected to a vacuum pump and a vacuum exhaust. As can be seen from the aforesaid patent, each of the suction cups travels through a hypotrochoidal path about the axes of the drive shaft. The path has three points disposed 120° apart. At these points, the suction cups are facing outwardly away from the drive shaft. Between the three outward points, the suction cups face inwardly toward the drive shaft. A coupon tray is placed adjacent one of the points and an article displacement location is adjacent another of the points. A vacuum is applied to the suction cup immediately prior to the cup attaining the point adjacent the coupon tray and the vacuum is ended when the same cup has moved to a position adjacent to the discharge point. As a result, the suction picks an article from the tray and carries it 120° through the hypotrochoidal path until it reaches the discharge point at which location the vacuum is ended so that the coupon is placed in its desired position.

It is desirable to use an apparatus such as that described in U.S. Pat. No. 4,350,466 to also apply a glue to an article which has been picked up by a suction cup and is being carried to its desired location. One way to accomplish this is to have the suction cup pick up an article at one of the three points of the path and carry it to a second point at which location a glue is applied. The apparatus then carries the glued article to the third point of the path at which location the article is discharged. Accordingly, an article is carried 240° about the drive shaft with 0° being defined at the pick-up point, 120° as the glue application point and 240° as the discharge point. An unfortunate problem with such an apparatus is that the glue applied to the article is minimal and is often insufficient in amount.

SUMMARY OF THE INVENTION

According to a preferred embodiment of the present invention, a pick-and-place glue applicator is provided having a support shaft mounted to rotate about an axes of rotation. A suction cup is secured to the support shaft and extends radially therefrom to a suction end. Means are provided for rotating the support shaft about its axis and simultaneously moving the shaft in an orbit about a primary axis parallel to and spaced from the support shaft axis. The support shaft rotates in a direction opposite from a direction of rotation of the orbit. The suction cup follows a repeating path as the shaft completes an orbit. Each repeating path includes a plurality of outwardly projecting positions with the cups projecting away from the primary axis and a plurality of connecting paths between the outwardly projecting positions with the cup facing inwardly toward the center of the orbit as the cup moves along the connecting paths. A vacuum and vacuum exhaust are alternately applied to the suction cup with a support for articles to be picked being adjacent one of the outwardly projecting positions. A glue applicator is placed positioned within the orbit adjacent a connecting path between outwardly extending positions.

DESCRIPTION OF THE PREFERRED EMBODIMENT

Figure 1:
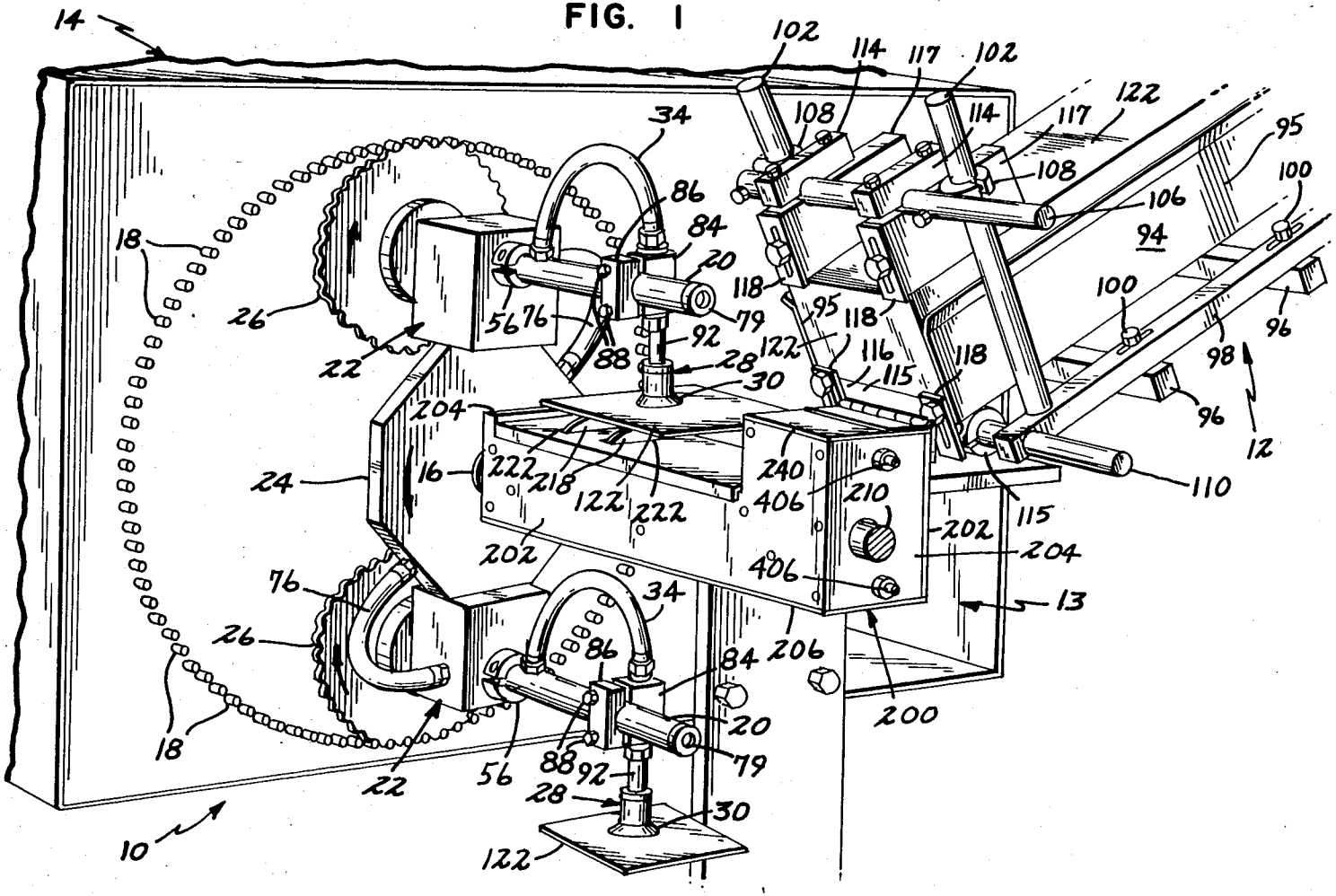
FIG. 1 is a perspective view of the invention.

Referring now to the drawings wherein like reference numerals designate identical or corresponding parts throughout the several views, and more particularly to FIG. 1, an article handling apparatus is designated generally as 10 and a tray mechanism is designated generally as 12. A glue applicator is shown generally at 13. A support member is shown at 14.

In a preferred embodiment, support member 14 not only supports a drive shaft 16, but also holds a plurality of pins 18 equidistantly spaced along the circumference of a circle concentric to drive shaft 16. Two support shafts 20 are individually held by bearing mechanisms 22 on hub 24 about drive shaft 16. A sprocket 26 is fixed to the end of each support shaft 20 adjacent support member 14. A suction cup mechanism 28 is fastened to the opposite end portion of each support shaft 20. Support shafts 20 rotate as a unit with drive shaft 16 about its axis as drive shaft 16 is driven, and at the same time, pins 18 engage sprockets 26 causing support shafts 20 to rotate individually in a direction opposite the rotational direction of drive shaft 16. The directions of rotation are shown by the arrows in FIGS. 1 and 5.

Figure 2:
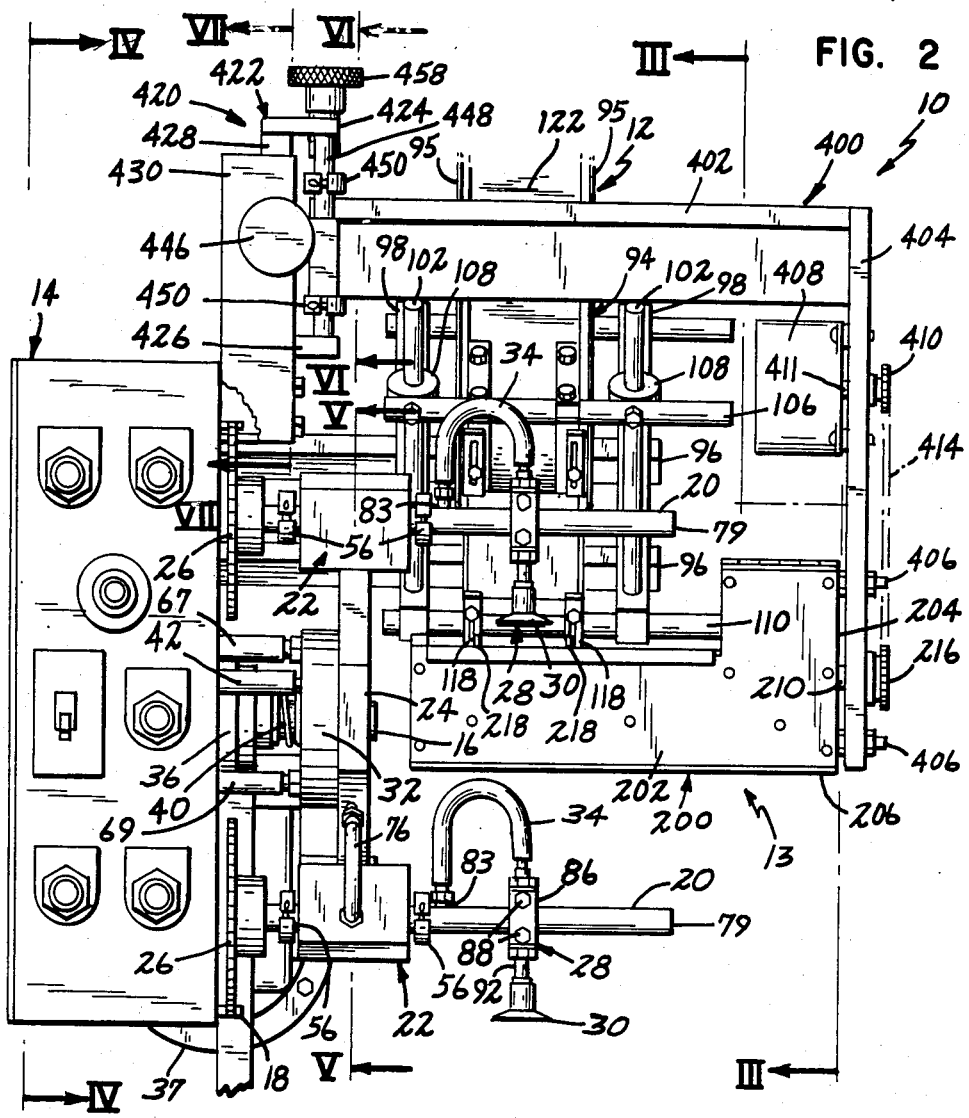
FIG. 2 is an end view taken in elevation of the invention.

Vacuum is applied by a vacuum pump (not shown) through a series of flexible, tubular lines and other components to the suction cups 30 which are a part of the suction cup mechanisms 28. The vacuum pump is in fluid communication with a valve body 32 (see FIG. 2) and hub 24, which, having a series of passageways therein, functions as a manifold. As hub 24 rotates with drive shaft 16 relative to nonrotatable valve body 32, which is in sealing contact with hub 24, air passes through valve body 32 and a particular set of passageways in hub 24. Each passageway in hub 24 is in fluid communication with a particular bearing mechanism 22 which in turn is in fluid communication with the hollow center portion of the particular support shaft 20. A flexible line 34 places suction cup mechanism 28 in fluid communication with the center of the support shaft 20. As the drive shaft 16 rotates, each suction cup mechanism 28 is alternately placed through valve body 32 in fluid communication with the suction pump and the atmosphere.

The article handling apparatus 10 is operable when a particular suction cup 30 is both in fluid communication with the vacuum pump and positioned to be in facial contact with an article held by tray mechanism 12. The vacuum causes an article to adhere to the particular suction cup 30 and rotate with it until the suction cup 30 is placed in fluid communication with atmospheric pressure.

Figure 4:
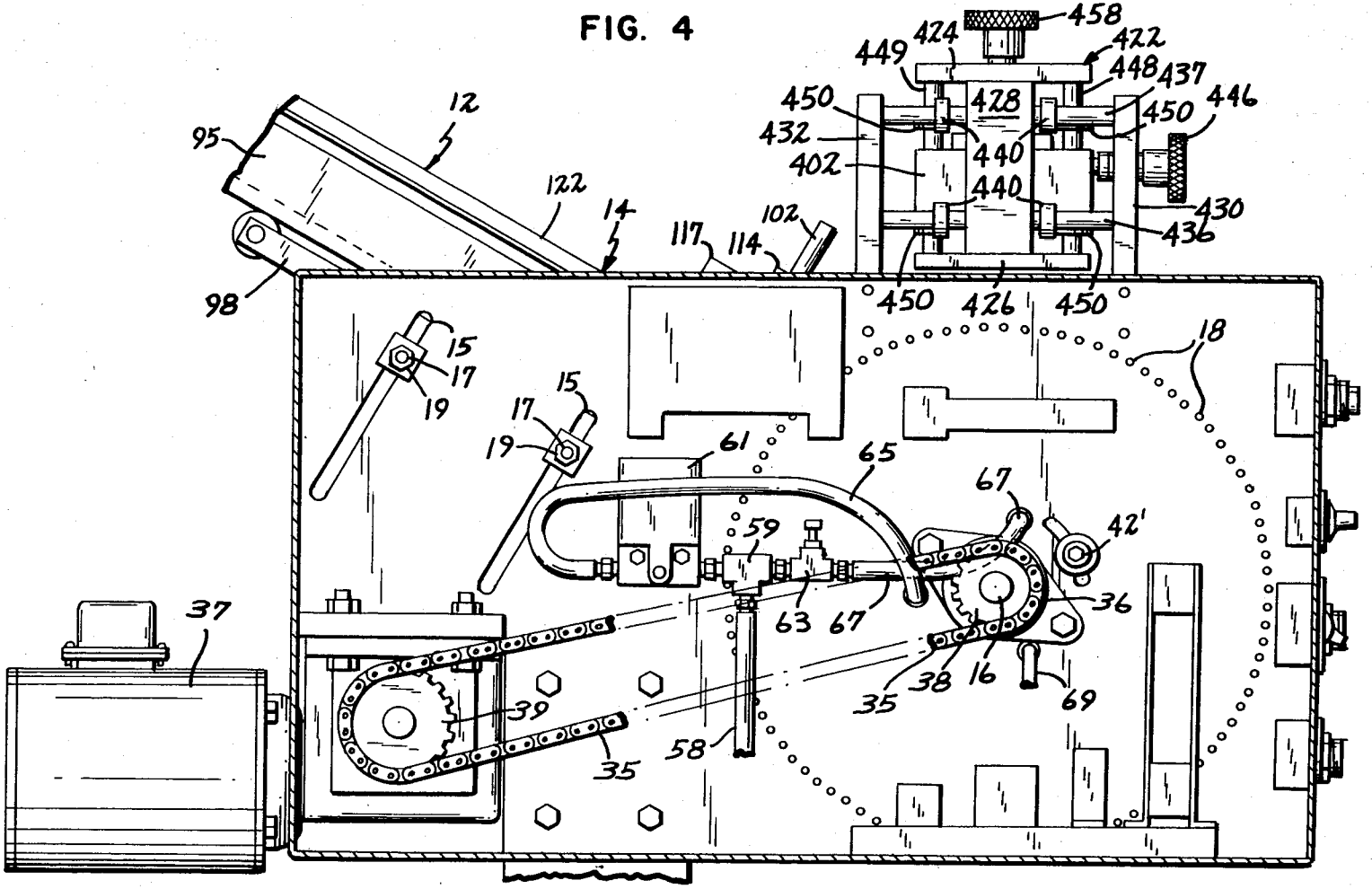
FIG. 4 is a view taken along lines IV—IV of FIG. 2.

Describing the structure more particularly, support member 10 may assume a variety of shapes or consist of various ancillary structure as long as the area inside a circle which includes pins 18 is flat. Drive shaft 16 extends through support member 14. Bearing 36, of a type commonly known, holds drive shaft 16 rotatably relative to support member 14. Rotative energy may be provided, of course, to drive shaft 16 by any of various power sources. One means is to attach a sprocket 38, as shown in FIG. 4, to one end of drive shaft 16 and connect a chain 35 between sprocket 38 and driver sprocket 39 connected through linkage to a motor 37. Hub 24 is fixedly attached to the other end of drive shaft 16. Valve body 32 encircles drive shaft 16 at a location between bearing 36 and hub 24. Valve body 32 is forced into fluid-sealing contact with hub 24 by spring 40, compressively placed between bearing 36 and valve body 32 in an encircling fashion about drive shaft 16 (shown best in FIG. 2). Valve body 32 is supported on drive shaft 16 by a bearing (not shown) and is held nonrotatably with respect to support member 14 by stud 42. Stud 42 is attached by a screw or other fastener 42' (FIG. 4) to support member 14 and extends from it. The stud has a pin (not shown) having one end pressed or otherwise fastened into the projecting end of stud 42 with a second end inserted into a closely fitting hole in valve body 32. Such an arrangement is fully shown in U.S. Pat. No. 4,350,466.

As described in the aforesaid patent, the longitudinal positioning of the shaft 16 can be adjusted to modify the compression of spring 40. Accordingly, it is possible to balance the fluid-sealing efficiency between valve body 32 and hub 24, which is better as compression force is increased, against frictional force and heat build up, which is higher as compression force is increased.

Hub 24 can assume a variety of different shapes. As shown in a preferred embodiment in FIG. 2, however, hub 24 has a substantially octagonal outer periphery. In this configuration, bearing mechanisms 22 are fastened to diametrically opposed edge surfaces of hub 24. The bearing mechanisms 22 support the support shafts 20 for rotation about their cylindrical axes with the axis spaced from and parallel to shaft 16. Examples of such bearing mechanisms 22 are shown in U.S. Pat. No. 4,350,466. Collars 56 are fastened to the support shaft 20 on either side of the bearing mechanism 22 to hold support shaft 20 longitudinally fixed relative to bearing mechanism 22.

Sprocket 26, of a type commonly known is fastened to one end of support shaft 20 between bearing mechanism 22 and support member 14. As indicated previously, pins 18 are pressed into holes or otherwise fastened to support member 14 in a regularly spaced arrangement along the circumference of a circle concentric to drive shaft 16. The diameter of the circle is such that pins 18 register in the indentations of sprockets 26 as the support shafts 20 rotate with drive shaft 16. Thus, sprockets 26 and pins 18 cause the support shafts 20 to rotate in a direction opposite to the rotational direction of drive shaft 16 as the several shafts rotate as a unit.

The vacuum application mechanism for article handling apparatus 10 includes a commonly-known vacuum pump (not shown). Line 58, shown in FIG. 4, provides fluid communication between the vacuum pump and a T-fitting 59. The T-fitting 59 connects the source vacuum line 59 with a solenoid operated valve 61 on one side and a needle valve 63 on another. A solenoid controlled vacuum line 65 extends from solenoid 61 to valve body 32. A needle valve controlled vacuum line 67 extends from needle valve 63 to valve body 32. A vacuum exhaust line 69 extends from the valve body 32 to an exhaust end (not shown) in air flow communication with atmosphere.

Figure 5:
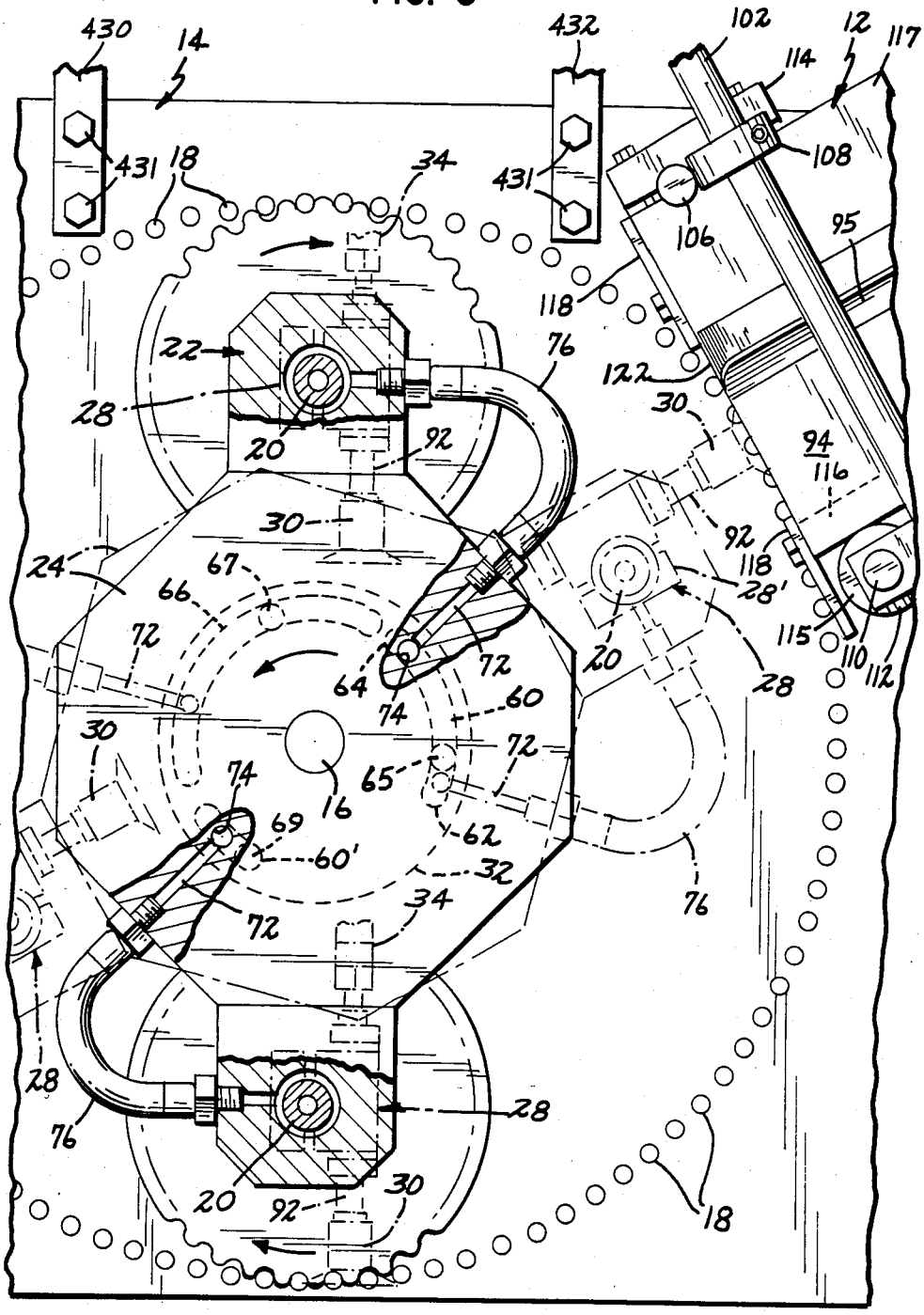
FIG. 5 is a view taken along lines V—V of FIG. 2.

Valve body 32 is shown with dotted lines in FIG. 5. Valve body 32 has a first long slot segment 60 centered on the circumference of a circle concentric with drive shaft 16. The ends of slot 60 are semi-circular. Slot 60 extends approximately 240° counter-clockwise from end 62 when viewing the valve body 32 from the side which contacts hub 24 to end 64. An opening passes through valve body 32 in order to provide fluid communication between solenoid controlled vacuum line 65 and slot 60. A second long slot 66 is located along the circumference of the same circle as slot 60 counter clockwise from end 64 of slot 60. An opening passes through valve body 32 in order to provide fluid communication between slot 66 and needle valve controlled vacuum line 67. A third slot segment 60' is located along the circumference of the same circle as slots 60 and 66 counterclockwise from slot 66. An opening passes through valve body 32 in order to provide fluid communication between slot 66 and vacuum exhaust line 69. Valve body 32 has sufficient width to accommodate slots 60, 66 and 60'. The peripheral shape of valve body 32 is not particularly important as long as valve body 32 is sufficiently large to include the indicated slots and holes.

As shown in FIG. 5, hub 24 has passageways 72 extending inwardly from approximately the center of octagonal edges adjacent the various bearing mechanism 22. Each passageway 72 extends inwardly to a point approximately the same distance from the axis of drive shaft 16 as the inner edge of slots 60 and 60' and slot 66. Each passageway 72 is vented at its inner end with an opening toward valve body 32 (such as openings 74). In this manner, hub 24 acts as a manifold with each passageway 72 alternately coming into registration with slot 60, slot 66 and slot 60' of valve body 32 as the shaft 16 is rotated, thereby placing each passageway alternately in fluid communication with the solenoid controlled vacuum line 65, the needle valve controlled vacuum line 67 and the vacuum exhaust line 69.

The angular orientation of valve body 32 with respect to the orientation of hub 24 at the moment a passageway 72 first comes into fluid communication with slot 60 during a revolution of hub 24 determines the relative location of a particular support shaft 20 when a solenoid controlled vacuum is first applied to the particular support shaft 20 and suction cup mechanism 28 in fluid communication with the particular passageway 72. Adjustment of the orientation of the suction cup mechanisms 28 and the tray mechanism 12 relative to each other insures coupon 122 pickup shortly after vacuum application. The length of slot 60 and subsequent proximity of slot 66 determine the duration of solenoid controlled vacuum application to a particular suction mechanism 28 and resultant orientation of same when it is placed in fluid communication with the atmosphere. As shown by the broken line positioned cup mechanism 28' in FIG. 5, if the end 62 of slot 60 is located somewhat below the horizontal relative to drive shaft 16, then a particular suction cup mechanism 28' is ready to pick a coupon when the particular support shaft 20 for mechanism 28' is somewhat above the indicated horizontal. The length of slot 60 and positioning of slot 66 are such that a cup mechanism 28 is in communication with needle valve controlled slot 66 before the next successive cup mechanism is in communication with solenoid controlled slot 60. The upper end of slot 60' is located to allow suction cup mechanism 28 to be placed in fluid communication with the atmosphere just before support shaft 20 for mechanism 28 is vertically below drive shaft 16.

Each passageway 72 is connected at its end away from valve body 32 by a line 76 to a different bearing mechanism 22. A particular line 76 includes a tube and various fittings as is well-known in the art, to make the connections at hub 24 and one of the bearing mechanisms 22. As is known in the art and as shown in U.S. Pat. No. 4,350,466, the interior of each hollow support shaft 20 is in air flow communication with its associated line 76. Each support shaft 20 also has a plug 79 at each end thereof to maintain fluid communication integrity in the vacuum application mechanism.

As shown in FIG. 1, line 34 provides fluid communication between the hollow portion of support shaft 20 and the suction cup mechanism 28. One end of line 34 is connected to an opening 83 which extends through the wall of support shaft 20 to the hollow portion of support shaft 20. Opening 83 is located adjacent the collar 56 on the side of bearing mechanism 22 away from support member 14. Line 34 is comprised of flexible tubing and standard fittings well-known in the art.

Suction cup mechanism 28, also shown in FIG. 1, includes a clamp having a body member 84 and a clamp member 86. The clamp is made from a rectangular block having thickenss greater than the internal diameter of line 34. A hole having a diameter approximately equal the outer diameter of a support shaft 20 is formed through the block. The block is cut transversely along a line passing through the center of the hole to form body member 84 and clamp member 86. Screws 88 pass through openings in clamping member 86 on either side of support shaft 20 into corresponding threaded openings in body member 84. In this manner, screws 88 tighten clamp member 86 and body member 84 onto support shaft 20 so a suction cup mechanishm 28 may be longitudinally and angularly adjusted along support shaft 20. A line 34 passes transversely through body member 84 so as to by pass support shaft 20. Suction cup 30 is connected via non-flexible line 92 to line 34. Suction cup 30 has a hole in the outer surface of the cup placing the cup volume adjacent the outer surface of the cup in fluid communication through a passageway in suction cup 30 with line 92 and ultimately the vacuum pump. Suction cup 30 is a commonly-known, commercially-available part.

As indicated previously, a suction cup mechanism 28 attracts and holds a coupon 122 or other article from a suitable pile, stack or tray mechanism. One type of suitable tray mechanism 12 is shown in FIG. 1. Tray mechanism 12 includes a container 94 having two sides 95 and a substantially open bottom having only bars 116 attached lengthwise to the lower portion of each side 95. Container 94 is angularly raised with respect to the horizontal at its non-dispensing end and is approximately perpendicular to support shafts 20. Container 94 rests on a support structure comprised of two spaced-apart, bottom support bars 96 and two side support bars 98. The bottom support bars 96 are attached at one end to support member 14 and extend outwardly from it. The side support bars 98 run approximately parallel to and on either side of container 94 and are attached with screws 100 to bottom support bars 96. A post 102 rises upwardly at approximately a right angle from each of side support bars 98 near the ends thereof at the dispensing end of tray mechanism 12. Posts 102 are attached to side support bars 98 with screws 104. An upper, cross post 106 extends between posts 102 at a location above container 94 with coupons 122 therein and is attached to posts 102 with vertically-adjustable collar clamps 108. Similarly, a lower, cross post 110 extends between side support bars 98 and is attached to them with screws 112. Two horizontally-adjustable clamps having upper bars 114 and lower bars 117 are connected to upper cross post 106. Two horizontally adjustable collar clamps 115 encircle lower cross post 110. Bars 116 are attached at the lower surfaces of each to the respective lower collar clamps 115. Retainers 118 are attached to the ends of bars 117 and 116 at the dispensing end of tray mechanism 12. A stack of coupons 122 rests edgewise on the two lower bars 116 with the face of the lowermost coupon resting against retainers 118. It is preferable for tray mechanism 12 to be oriented with its dispensing end downward so coupons 122 are gravitationally forced to continually press against retainers 118.

Figure 18:
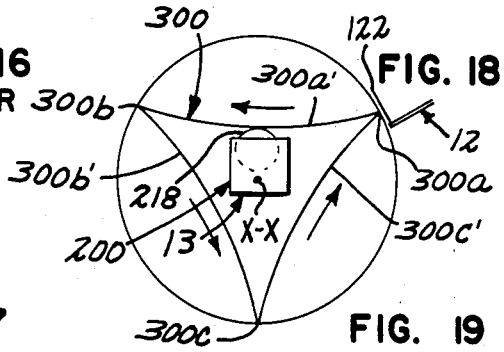
FIG. 18 is a schematic view of the present invention.

The tray mechanism 12 is adjustably secured to the support frame 14 by means of elongated slots 15 formed through support frame 14 (shown in FIG. 4). Threaded studs 17 extending from cross bars 96 extend through the slots 15 and nuts 19 engage the studs 17 to fixedly clamp the tray mechanism 12 in a desired angular position. Preferably, the tray mechanism is positioned such that a leading coupon 122 held within the tray 12 is disposed orthoganally to an outwardly projecting point of travel of the suction cups 30. In this regard, reference is directed to FIG. 18 which shows a hypotrochoidal path 300 traced by a suction cup as drive shaft 16 completes one revolution. The hypotrochoidal path 300 includes points 300*a*, 300*b* and 300*c* disposed 120° about the axis X—X of shaft 16. Connecting paths 300*a*', 300*b*' and 300*c*' connect points 300*a*, 300*b* and 300*c*. As schematically shown in FIG. 18, the tray mechanism 12 is positioned with the leading coupon 122 contacting point 300*a*.

Figure 16:
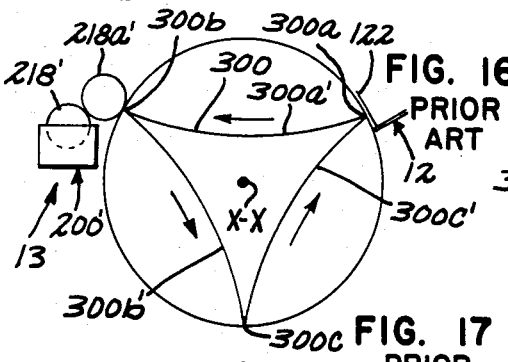
FIG. 16 PRIOR ART
FIG. 16 is a schematic view of a prior art glue applicator.
Figure 17:
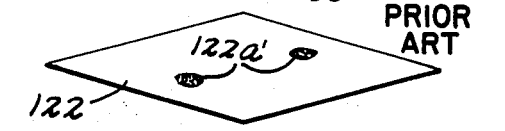
FIG. 17 PRIOR ART
FIG. 17 is a perspective view of a coupon having glue applied by a prior art glue applicator.

In prior art pick-and-place glue applicators, a glue applying device 13' would be placed adjacent point 300*b* as shown in FIG. 16. The device 13' included a glue pot 200' with parallel spaced apart disks 218' for drawing glue from the pot 200' and transferring it to second disks 218*a*'. Disks 218*a*' were positioned to contact a coupon 122' on a cup at point 300*b*. Such an arrangement would result in two spots of glue 122*a*' deposited on the coupon 122' where the coupon 122' touched disks 218*a*' as shown in FIG. 17. Unfortunately, this small amount of glue is often unsatisfactory.

The improved pick-and-place machine of the present invention has a glue applicator 13 which will now be described with reference to FIGS. 1–3 and 6–11. The glue applicator 13 includes a glue pot 200 shown best in FIG. 8–11. The glue pot 200 includes a pair of spaced apart side walls 202 and connecting end walls 204. Side walls 202 and end walls 204 are joined by a common base 206. An interior floor 206' is spaced above base 206 and together with walls 202, 204 defines a glue chamber 208. A rotary shaft 210 extends the length of the glue pot 200 and is disposed with chamber 208. The shaft is mounted for rotation about its axis by first and second bearings 212 and 214 carried on opposing end walls 204. The shaft extends beyond one of the end walls 204 and terminates at an end provided with a sprocket 216. Concentrically mounted on the shaft 210 are a pair of spaced apart identical circular glue applying disks 218. A cover 220 is provided covering chamber 208 with a pair of spaced apart slots 222 disposed for upper portions of the disks 218 to pass through the slots 222. A heating element 224 is disposed beneath floor 206' and includes a heating plate 226 having electrode connections 228.

Figure 9:
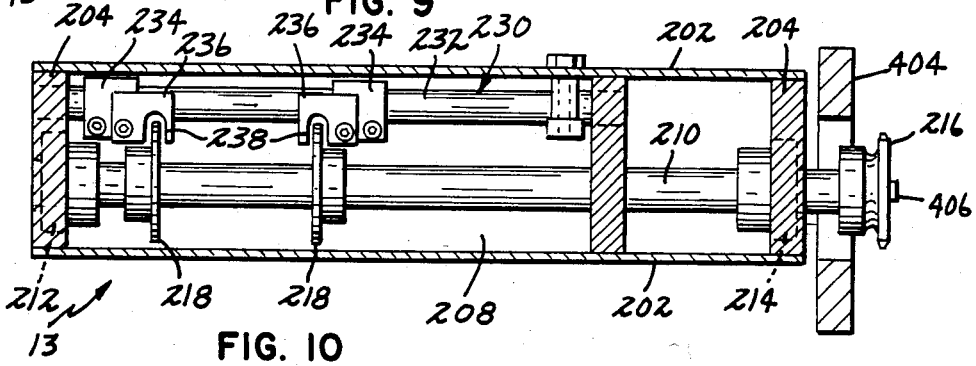
FIG. 9 is view taken along lines IX—IX of FIG. 8.
Figure 10:
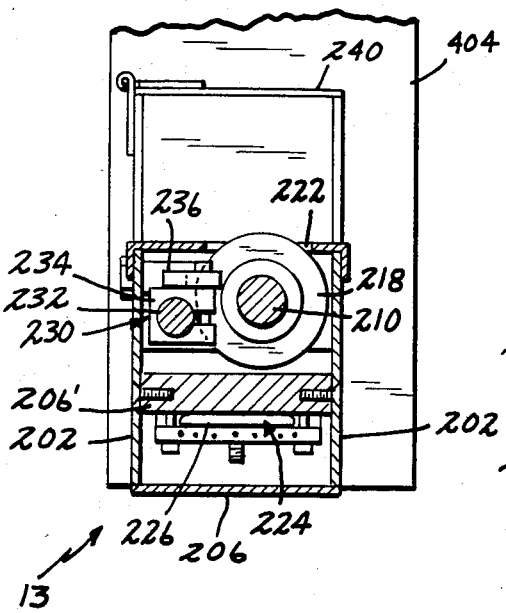
FIG. 10 is a view taken along lines X—X of FIG. 8.
Figure 11:
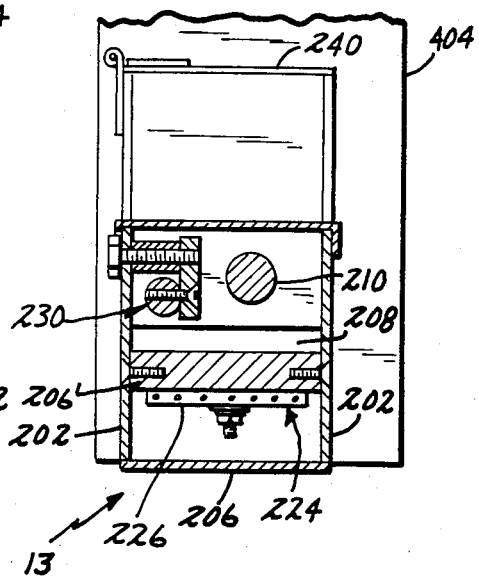
FIG. 11 is a view taken along lines XI—XI of FIG. 8.

Glue within the glue chamber 208 is heated by the heating element 224 to achieve a desired viscosity. As the shaft 210 rotates, glue is carried by the rotating disks 218. A glue metering apparatus 230 is provided as best shown in FIGS. 9 and 10. The glue metering apparatus 230 includes a support bar 232 having a pair of clamps 234 which may be releasably secured in a plurality of positions along the bar 232. Each of the clamps 234 is provided with a glue restricter in the form of a doctor blade 236 having glue passage slots 238. Opposing surfaces of the glue passage slots 238 and the disks 218 provide a restricted passage so that only a metered amount of glue may pass between the glue restricter 236 and disks 218 as the disks 218 rotate in clockwise direction when viewed in FIG. 10. Accordingly, only a uniform thickness of glue will be disposed on the exposed portion of the disks 218 above the cover plate 220. The glue pot 200 is provided with a hinged lid 240 through which glue may be admitted into the chamber 208 as desired.

In order to securely align the glue applying disk 218 and the pick-and-place apparatus 10 while aligning the apparatus 10 adjacent an article conveyor, a novel support for the glue pot 200 is provided.

With reference to FIGS. 2, 3, 6 and 7, the glue pot 200 is supported by a support structure shown generally at 400. Shown best in FIG. 2, the support structure includes a horizontal member 402 extending perpendicularly away from frame member 14 above the axis of rotation of shaft 16. The horizontal member 402 is sized to extend beyond the length of the support shafts 20 to a free end. At the free end of horizontal member 402, a vertical support member 404 extends downwardly. The glue pot 200 is secured to the vertical member 404 by means of a plurality of nut and bolt means 406. A motor 408 is also supported by the vertical member 404 and is provided with a sprocket 410 mounted on the motor shaft 411. Sprocket 410 is connected to sprocket 216 by means of chain 414.

The horizontal member 402 and vertical member 404 are sized such that the glue pot 200 is received within the area bounded by the hypotrochoidal path 300 of the suction cups 30. More specifically, the glue pot 200 is positioned such that the disks 218 are located to engage and apply glue to an opposing surface of an article 122 carried by a suction cup 30 as it passed from point 300*a* to 300*b* (as shown in FIG. 18). Accurate positioning of the glue pot 200 is obtainable by means of the positioning apparatus generally shown at 420.

Figure 7:
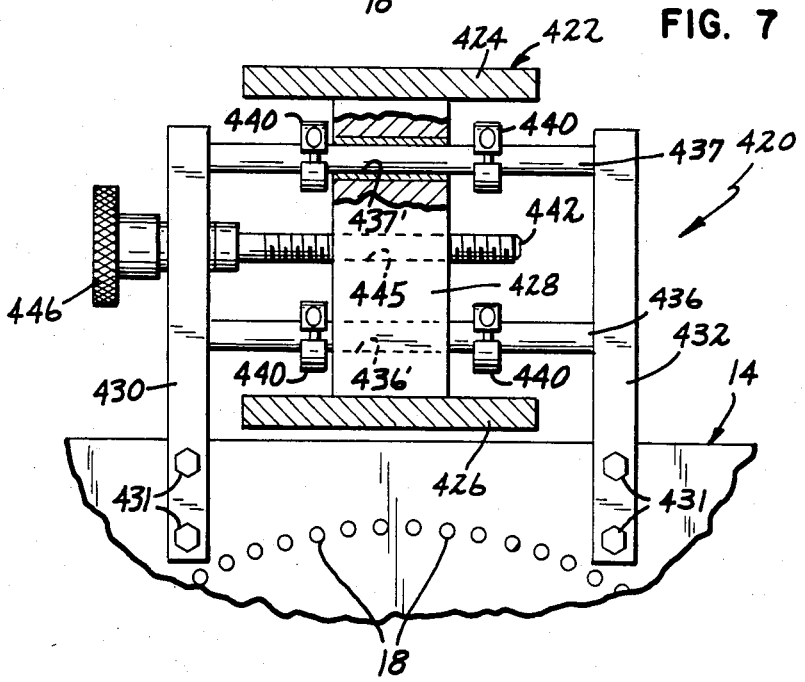
FIG. 7 is a view taken along lines VII—VII of FIG. 2.
Figure 8:
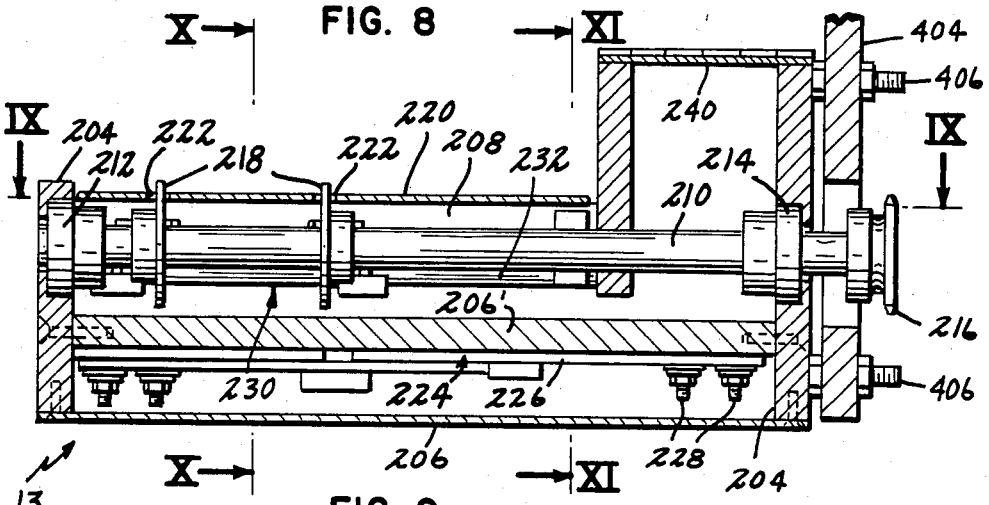
FIG. 8 is an elevation view taken in section of a glue applicator for the present invention.

Positioning apparatus 420 includes means for independently adjusting the vertical and horizontal positioning of the glue pot 200 in a plane parallel to the orbit of the suction cups 30. With reference to FIG. 7, a brace member 422 is shown comprising a pair of vertically spaced apart horizontal parallel plates 424 and 426. The plates 424 and 426 are joined by a vertical spacer bar 428. A pair of vertical parallel spaced apart support plates 430 and 432 are secured to frame member 14 by means of screws 431 and are disposed on opposite sides of brace member 422.

Vertical support plates 430 and 432 are interconnected by a pair of parallel horizontal spaced apart rods 436 and 437 which pass through aligned bores 436', 437' formed through vertical spacer bar 428. Stop collars 440 are secured to each of the rods 436, 437 on opposite sides of the brace member 422. As a result, brace member 422 is free to move from left to right (as shown in FIG. 7) with the range of motion being limited by stop collars 440. An adjusting rod 442 is rotatably mounted in one of the verticle spaced apart plates 430 and has a threaded end which is received within a threaded bore 445 of vertical plate 428. A handle 446 is secured to an opposite end of rod 442. By turning handle 446, brace 422 can be moved horizontally between stops 440.

Figure 6:
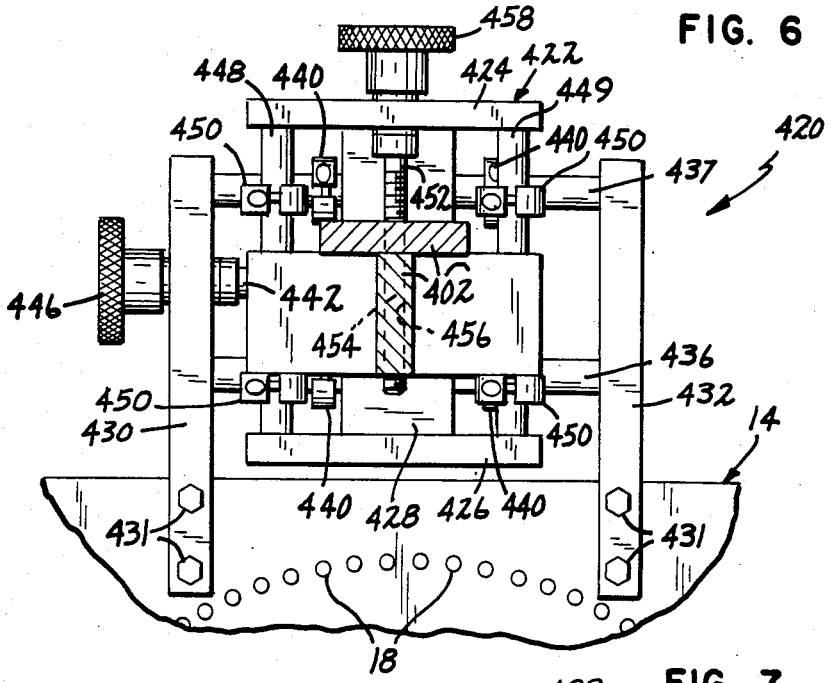
FIG. 6 is a view taken along lines VI—VI of FIG. 2.

Referring now to FIG. 6, brace 422 includes a pair of vertical spaced apart rods 448, 449 extending between horizontal spaced apart plates 424 and 426. The rods 448 pass through bores (not shown) formed in horizontal support member 402 with support member 402 vertically slidable on rods 448. Stop collars 450 are provided on the rods 448, 449 on opposite sides of horizontal support member 402. Accordingly, the stop collars 450 provide for a path for limited movement of the horizontal support member 402 in a verticle direction between the stop collars 450. An adjusting rod 452 is rotatably mounted in upper horizontal plate 424 and extends downwardly to a threaded end 454 which is received within a vertical threaded bore 456 of horizontal support member 402. A handle 458 is provided on an opposite end of adjusting rod 452. Accordingly, by turning handle 458, horizontal support member 402 may be moved and adjusted vertically. Therefore, selective adjustment by reason of turning handles 458 and 446, provide for accurate positioning in both the verticle and horizontal dimension parallel to the orbit of the cups 30.

In operation, the drive shaft 16 of the article handling apparatus 10 is driven by a motor 37 through a chain 35 about sprockets 39 and 38. At the same time, a vacuum pump operates to draw air from line 58. Support shafts 20 are connected by bearing mechanisms 22 and hub 24 to drive shaft 16 and, consequently, rotate as a unit about drive shaft 16 and maintain a constant spacial relationship relative thereto. Sprockets 26 attached to the ends of drive shafts 20 engage pins 18 and cause support shafts 20 to rotate individually in a direction opposite the rotational direction of drive shaft 16 as drive shaft 16 and support shafts 20 rotate as a unit. Thus, when drive shaft 16 rotates counter-clockwise as viewed from the article handling side of support member 14, the axis of a particular support shaft 20 maintains a constant spacial relationship relative to drive shaft 16 by moving counter-clockwise therewith. The support shafts 20, however, also rotate individually in a clockwise direction. Thus, a particular suction cup 30, located along a radius extending from the axis of a particular support shaft 20, moves clockwise on a counter-clockwise hypotrochoidal path.

Valve body 32 is fixed relative to hub 24 which rotates with drive shaft 16. Consequently, a suction cup 30 connected to a particular support shaft 20 is in fluid communication with the vacuum pump only when the opening 72, with which the particular suction cup 30 is in fluid communication, is also in fluid communication with slots 60 or 66 of valve body 32. In like manner, the suction cup 30 is in fluid communication with the vacuum exhaust 69 only when the applicable opening 72 is in fluid communication with slot 60' of valve body 32. Thus, a particular suction cup 30 has a vacuum applied to it when the applicable opening 72 first registers with slot 60. Vacuum continues to be applied as opening 74 moves along slot 60. Preferably, solenoid valve 61 is connected to any conventional detection and timing apparatus which detects the presence or absence of articles approaching on a conveyor to receive a coupon 122. If an article is detected approaching point **300*c*, solenoid valve 61 is switched on to create a vacuum in slot 60 for the cup 30 which is timed to be at point 300*c* with the article. If, however, no article is approaching point 300*c* on a conveyor, solenoid valve 61 is switched off so that a vacuum is not applied to slot 60 for a cup 30 timed to arrive at point 300*c* simultaneous with the gap in the article flow on a conveyor. Therefore, a coupon 122 is only selected from tray mechanism 12 when an article is approaching on the conveyor to receive the coupon 122 at point 300*c*. Once the coupon 122 is selected and receives an application of glue (as will be described), the carrying cup 30 comes in fluid communication with needle valve controlled slot 66 which is constantly under vacuum. A cup 30 carrying a coupon 122 is in communication with slot 66 before the solenoid need be turned off for the next approaching cup 30. The cup 30 with opening 72 stays in vacuum as it passes through slot 66 until it reaches slot 60' at which point the vacuum is lost and suction cup 30 is placed in fluid communication with the atmostphere. The pressure at suction cup 30 remains at the atmospheric level until opening 74 again registers with slot 60. Alternatively, slot 60' could have a slight positive pressure to urge a coupon 122 off of a carrying cup 30** and cleanse dirt from the cup and vacuum lines.

As a result of the foregoing structure, the suction cups 30 move in the hypotrochoidal path shown in FIG. 18. At points **300*a*, 300*b* and 300*c*, the suction cups are facing outwardly away from the axis X—X of rotation. Between these points, the cups 30 are facing into the ara bounded by the hypotrochoidal path. More specifically, it can be seen that at the location intermediate outwardly projecting points, the suction cups 30 are facing the axis X—X and move in a generally linear path. Slots 60, 66 and 60' are sized in position such that a suction cup 30 is under vacuum just as it approaches point 300*a* (assuming an article is approaching on a conveyor) and maintains the vacuum until it reaches point 300*c***.

Figure 13:
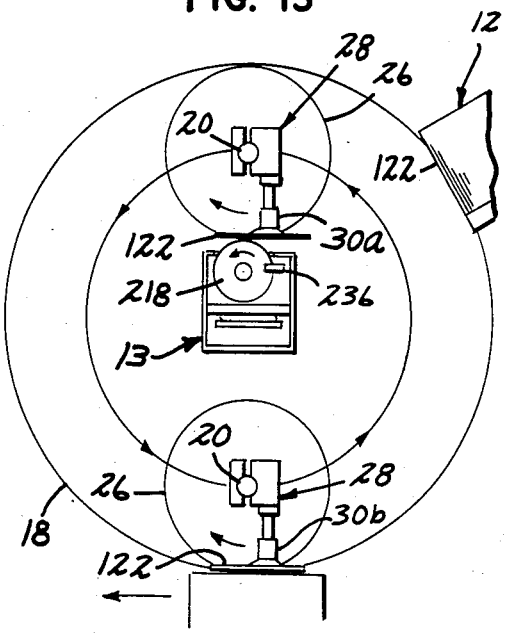
FIGS. 12, 13 and 14 are schematic representations of various positions of the apparatus of the present invention during its operation.
Figure 12:
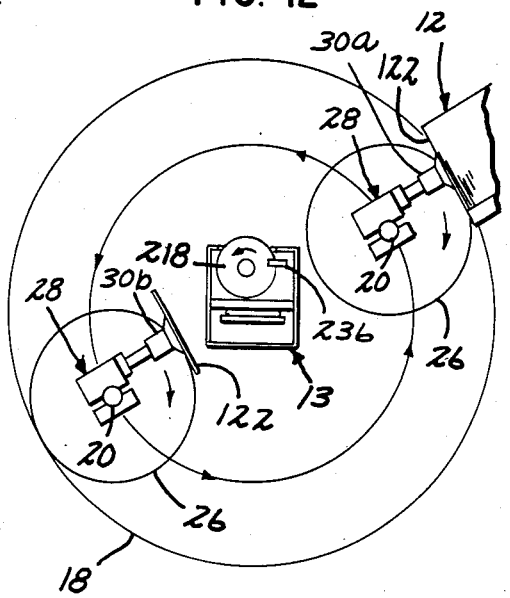
Figure 14:
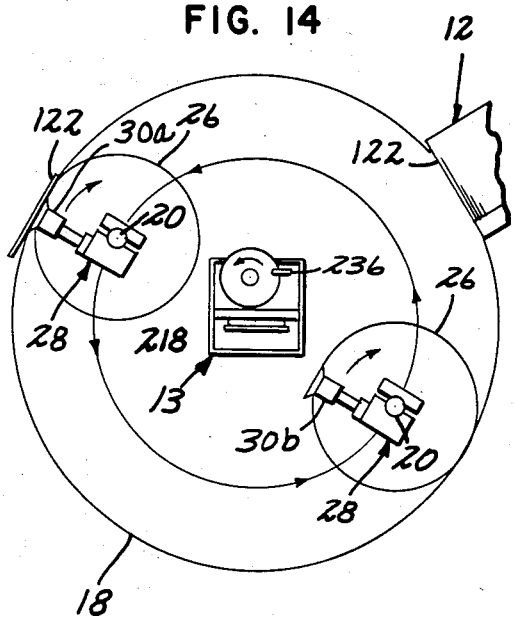

A sequence of operation is shown in FIGS. 12–14. In FIG. 12, a first suction cup **30*a* has just arrived at tray 12 containing coupons 122. At this location, suction cup 30*a* has reached point 300*a* of the hypotrochoidal path and is facing outwardly away from the center of rotation. Tray 12 is aligned such that in this position, cup 30*a* is in sealed contact with coupon 122. In this position, assuming an article is approaching, solenoid valve 61 is on and a vacuum is applied to slot 60. Therefore, a vacuum is applied on suction cup 30*a* such that coupon 122 will be pulled from tray 12 as suction cup 30*a* continues to move in its path. FIG. 12 also shows diametrically opposed second suction cup 30*b* carrying a coupon 122. In the position of FIG. 12, second suction cup 30*b* is at the center of the connecting path 300*b*'between points 300*b* and 300*c* of the hypotrochoidal path. In this position, cup 30*b* is in communication with needle valve controlled slot 66 and a suction is being applied to the cup 30*b*** and it is facing inwardly to the center of the axis X—X of rotation.

FIG. 13 shows the positioning of first and second suction cups **30*a* and 30*b* after the drive shaft has rotated 60°. In this position, suction cup 30*a* is at the center of the connecting path 300*a*' and is facing toward the center of the axis X—X of rotation. As shown in FIG. 13, glue pot 200 is positioned such that the rotating disks 218 will be in touching contact with a coupon 122 carried by first suction cup 30*a* as it passes the glue pot 200 toward hypotrochoidal path point 300*b*. Preferably, slot 60 (through control of needle valve 63 on slot 66) is at a higher vacuum than slot 66. Cup 30*a* stays in communication with slot 60 until after the glue is applied to avoid the coupon 122 being knocked off the cup 30*a* when it contacts disks 218. FIG. 13, also shows the positioning of second cup 30*b* which has now moved on the hypotrochoidal path to point 300*c* and is facing outwardly away from center X—X. Cup 30*b* is now in communication with slot 60' and vacuum is gone. At this point, an article to receive coupon 122 is carried by a conveyor (not shown) or any other suitable transportation means to be in touching contact with the glued surface of coupon 122**.

FIG. 14 shows the positioning of first and second suction cups **30*a* and 30*b* after drive shaft 16 has rotated an additional 60° away from the position shown in FIG. 13. In the position of FIG. 14, cup 30*a* has moved along hypotrochoidal path to point 300*b* with cup 30*a* facing outwardly away from the center of rotation. Cup 30*a* has now moved to be in communication with constant vacuum slot 66. Also cup 30***b*. has moved to the center of path 300*c'* and is facing inwardly to the axis X—X of rotation. As rotation continues, a vacuum will be reapplied to second suction cup 30*b* (assuming an article is approaching on the conveyor) such that when it approaches point 300*a* and is opposing a coupon 122 in tray 12, it will pick up the coupon and the cycle will be repeated.

Figure 19:
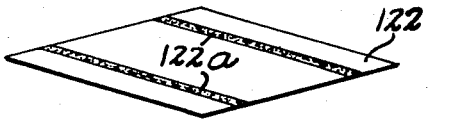
FIG. 19 is a perspective view of a coupon having glue applied by the present invention.
Figure 3:
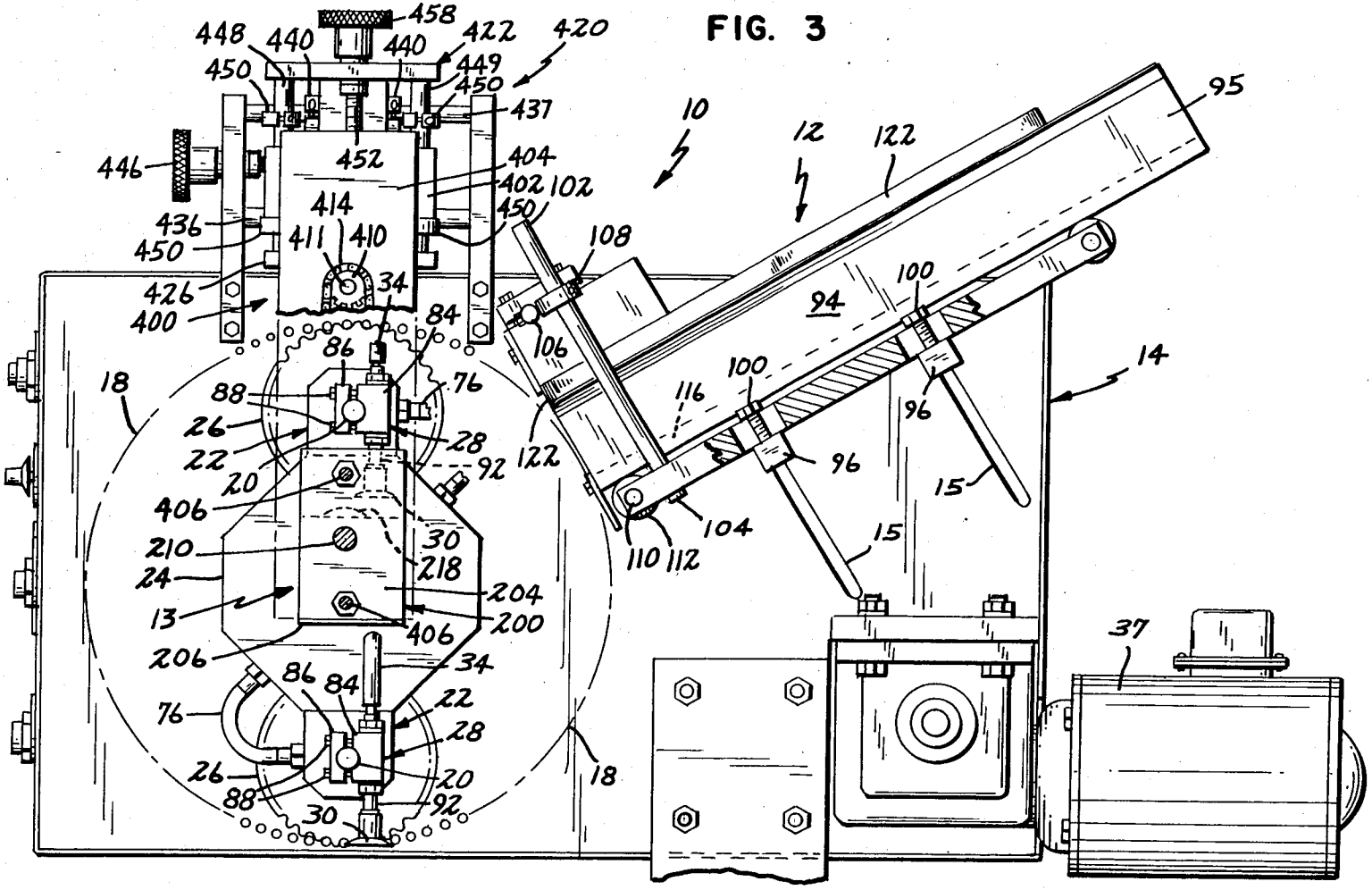
FIG. 3 is a view taken along lines III—III of FIG. 2.
Figure 15:
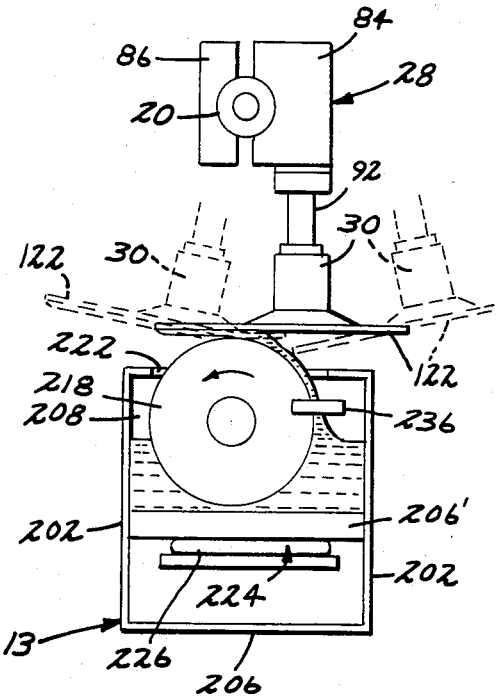
FIG. 15 is an enlarged view of a suction cup of the present invention passing a glue applicator of the present invention.

From the foregoing it can be seen that a coupon 122 being carried by a suction cup 30 passes in a generally linear path when it is opposing the disks 218 and glue pot 200. The glue application is shown in FIG. 15 in which the small arcuate path of the cup 30 is exaggerated to be greater than the generally linear path shown more accurately in FIGS. 16 and 18. From FIG. 15 it can be seen that coupon 122 being carried by suction cup 30 contacts disk 218 along its entire length and, as a result, receives a bead of glue along its entire length. FIG. 19 shows a coupon 122 having parallel spaced apart beads of glue 122*a* produced by contact with parallel spaced apart disks 218. It can be seen, that the amount of glue applied represents a significant advance over the prior art spot application shown in FIG. 17 at 122*a'* and insures greater adhesion between a coupon 122 and the article on which it is to be secured. Also, the novel support 400 and adjusting mechanism 420 provide accurate position of the glue applicator 13. By tying the glue applicator 13 to the support 14 in a cantilevered manner, the two may be moved from place to place in a factory while retaining positive alignment and without interference to a factory conveyor system.

Although numerous characteristics and advantages of the invention have been set forth in the foregoing description, together with details of the structure and function of the invention, it is to be understood that the disclosure is illustrative only. Any changes made, especially in matters of shape, size and arrangement, to the full extent intended by the general meaning of the terms in which the appended claim are expressed, are within the principle of the invention.

What I claim is:

1. A pick-and-place glue applicator comprising:

a frame member;

a support shaft supported on said frame member;

means for mounting said support shaft to rotate about a secondary axis of rotation;

a suction cup secured to said support shaft and extending radially therefrom to a suction end;

means for rotating said support shaft about said secondary axis and simultaneously moving said shaft in an orbit about a primary axis parallel to and spaced from said secondary axis with said support shaft rotating in a direction opposite from a direction of rotation of said primary axis with said suction cup following a repeating path as such support shaft completes an orbit, said repeating path including a plurality of outwardly projecting positions with said cups projecting away from said primary axis and a plurality of connecting paths connecting said positions with said cups in said connecting paths projecting into an area bounded by said repeating path;

said means for rotating said support shaft being arranged for said cup to move in a generally hypotrochoidal path having distinct outwardly projecting positions and having connecting paths between said positions with generally linear portions; said means for applying said glue positioned adjacent one of said linear portions;

means for producing a vacuum;

means for releasing a vacuum;

means for alternately connecting said cup to said vacuum means and vacuum release means;

said means for alternately connecting said cup to said vacuum means and vacuum release means includes means for applying a vacuum to a cup approaching one of said outwardly projecting positions and maintaining said vacuum as said cup passes said means for applying said glue to a subsequent outwardly projecting position;

means for supporting an article to be picked by said cup adjacent one of said outwardly projecting positions;

means for applying glue to an article supported by a cup as said cup moves along a connecting path; and said means for applying said glue being supported by said frame member and extending into a center of said orbit and presenting a glue applying surface opposing a linear portion of a connecting path and spaced therefrom a distance for an article carried by a cup to contact said glue applying surface to transfer glue from said surface to said carried article.

2. An applicator according to claim 1 comprising a glue pot and means for positioning said glue pot within said area bounded by said hypotrochoidal path with said means comprising a support member connected to a frame and means for adjusting a position of said support member.

3. A pick-and-place glue applicator comprising:

a frame member;

a drive shaft;

means for mounting said drive shaft on said frame member to rotate about a primary axis of rotation;

means for rotating said shaft about said axis;

a support shaft;

means for mounting said support shaft for rotation about a secondary axis parallel and spaced from said primary axis;

means for rotatably driving said support shaft including means for rotatably holding said support shaft such that said secondary axis remains in a constant spacial relationship relative to said primary axis and means for engaging so that said support shaft rotates in a direction opposite from said drive shaft as said drive shaft in said support shaft rotate as a unit relative to said frame member, said engaging means including a sprocket attached to said support shaft and planetary gear means immovable relative to said frame member, for engaging the outer circumference of said sprockets and causing said sprockets to roll along the interior of the circle, whereby said sprockets and support shafts are caused to rotate in a direction opposite from said rotational direction of said drive shaft when said sprockets engage said planetary gear means as said drive shaft and said support shaft rotate as a unit;

a suction cup attached to said support shaft and extending radially therefrom;

means for producing a vacuum; and means for alternately connecting said suction cup with said vacuum producing means and the atmosphere whereby an article is moved from a first location to a second location as said drive shaft and said support shaft rotate, said suction cups attracting and holding an article when a suction cup is connected with said vacuum producing means and releasing said article when said suction cup is connected with the atmosphere;

glue applying means having an article contacting glue transfer surface disposed within an area bounded by a path of travel of said suction cups and positioned with said glue transferring surface to contact a glue receiving surface of an article carried by a suction cup.

4. A glue applicator according to claim 3, wherein said glue applicator is connected to said frame member by means of a support arm extending from said frame member to said glue applicator.

5. An applicator according to claim 3 comprising means for adjusting the position of said glue applicator wherein said means include a brace;

means for slideably connecting said brace to said frame member for said brace to slide in a first direction relative to said frame member;

means for slideably connecting said support arm to said brace with said support arm slideable in a second direction to said frame member;

means for selectively adjusting the slideable position of said brace;

means for selectively adjusting the slideable position of said support arm.

6. An applicator according to claim 3 wherein said suction cup moves in a repeating path having a plurality of outwardly projecting positions connected by connecting path segments having linear portions with said glue applicator disposed within an area bounded by said repeating path with said glue transfer surface opposing said linear portion.

7. A glue applicator according to claim 6 wherein said repeating path is a hypotrochoidal path having outwardly projecting cup positions displaced 120° with a first of said positions adjacent a tray for containing articles to be selected by a cup and a second of said outwardly projecting positions adjacent a location for an object to receive a glued article;

said glue applicator disposed within an area bounded by said path adjacent a linear portion of a connecting path connecting said first and second outwardly projecting positions with said suction cup opposing said glue transfer surface as said suction cup moves along a generally linear path.

8. A pick-and-place glue applicator according to claim 1 comprising a plurality of said support shafts and suction cups with said means for producing a vacuum including first vacuum means for selectively applying a vacuum to a cup approaching an article to be picked and second vacuum means for applying a continuous vacuum to a cup carrying a picked article.

9. A pick-and-place glue applicator according to claim 8 wherein said first and second vacuum means are disposed for a cup to be controlled by said first vacuum means after a preceding cup has entered control of said second vacuum means.

10. A pick-and-place glue applicator according to claim 3 comprising a plurality of said support shafts and suction cups with said means for producing a vacuum including first vacuum means for selectively applying a vacuum to a cup approaching an article to be picked and second vacuum means for applying a continuous vacuum to a cup carrying a picked article.

11. A pick-and-place glue applicator according to claim 10 wherein said first and second vacuum means are disposed for a cup to be controlled by said first vacuum means after a preceding cup has entered control of said second vacuum means.

* * * * *